US006616228B2

(12) United States Patent
Heidmann

(10) Patent No.: US 6,616,228 B2
(45) Date of Patent: Sep. 9, 2003

(54) COMPLIANT BACK FOR SEATING UNIT

(75) Inventor: Kurt R. Heidmann, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/885,582

(22) Filed: Jun. 20, 2001

(65) Prior Publication Data

US 2002/0195853 A1 Dec. 26, 2002

(51) Int. Cl.[7] ..... A47C 7/46
(52) U.S. Cl. ..... 297/284.4
(58) Field of Search ..... 297/284.1, 452.31

(56) References Cited

U.S. PATENT DOCUMENTS

| | | | | |
|---|---|---|---|---|
| 3,762,769 A | * | 10/1973 | Poschl | 297/284.4 |
| 4,153,293 A | | 5/1979 | Sheldon | 297/284.4 |
| 4,157,203 A | | 6/1979 | Ambasz | |
| 4,585,272 A | | 4/1986 | Ballarini | |
| 4,601,514 A | * | 7/1986 | Meiller | 297/284.4 |
| 4,632,454 A | | 12/1986 | Naert | |
| 4,718,724 A | | 1/1988 | Quinton et al. | |
| 5,076,643 A | | 12/1991 | Colasanti et al. | |
| 5,217,278 A | | 6/1993 | Harrison et al. | |
| 5,320,410 A | | 6/1994 | Faiks et al. | |
| 5,344,211 A | | 9/1994 | Adat et al. | |
| 5,385,388 A | | 1/1995 | Faiks et al. | |
| 5,419,614 A | | 5/1995 | Richards et al. | |
| 5,518,294 A | | 5/1996 | Ligon, Sr. et al. | |
| 5,533,787 A | | 7/1996 | Xiang | |
| 5,551,752 A | | 9/1996 | Lovegrove et al. | |
| 5,553,917 A | | 9/1996 | Adat et al. | |
| 5,597,203 A | | 1/1997 | Hubbard | |
| 5,624,158 A | | 4/1997 | Adat et al. | |
| 5,711,575 A | | 1/1998 | Hand et al. | |
| 5,758,925 A | | 6/1998 | Schrewe et al. | |
| 5,816,654 A | | 10/1998 | Ellis | |
| 5,868,466 A | | 2/1999 | Massara et al. | |
| 5,902,011 A | | 5/1999 | Hand et al. | |
| 5,975,634 A | | 11/1999 | Knoblock et al. | |
| 5,984,408 A | | 11/1999 | Bujaryn | |
| 6,003,941 A | | 12/1999 | Schuster, Sr. et al. | |
| 6,036,265 A | | 3/2000 | Cosentino | |
| 6,086,153 A | | 7/2000 | Heidmann et al. | |
| 6,152,532 A | | 11/2000 | Cosentino | |
| 6,220,663 B1 | | 4/2001 | Benden et al. | |
| 6,254,187 B1 | | 7/2001 | Schuster, Sr. et al. | |

FOREIGN PATENT DOCUMENTS

| | | |
|---|---|---|
| GB | 2178652 A | 2/1987 |

* cited by examiner

*Primary Examiner*—Peter R. Brown
(74) *Attorney, Agent, or Firm*—Price, Heneveld, Cooper, DeWitt & Litton

(57) ABSTRACT

A compliant back for a seating unit includes a rigid upright defining a track, and a flexible back shell configured to support a seated user's upper body, including a top pivot pivotally connected to a top section of the back shell and a pivot/slide member slidably connected to the track of the back shell. A biasing device is operably coupled to the pivot/slide member that biases the pivot/slide member toward a position where the flexible back shell protrudes forwardly to a shape chosen to optimally support a seated user.

17 Claims, 5 Drawing Sheets

COMPLIANT BACK FOR SEATING UNIT

BACKGROUND

The present invention relates to back constructions for seating units, such as chairs, and more particularly relates to a back construction having a compliant back operably supported by and coupled to a back upright for movement between various flexed positions for optimal ergonomic and aesthetic support.

Many modern chairs include a front surface shaped to comfortably support a lumbar region of a seated user's back, and/or include a lumbar support placed on a front surface of the back support. Sometimes, the lumbar support is made adjustable. However, many of these constructions result in a back construction that is noticeably thick and heavy in appearance, which is undesirable in many chair designs. Further, it is preferable that any mechanisms that provide flexibility and/or adjustability be partially or fully hidden from view, so that they do not detract from the overall appearance of the chair. Still further, it is preferable that any lumbar adjusting mechanism not merely be an extra device with multiple pieces assembled onto a back, but instead that it be well integrated into the back. Also, it is preferable that any back construction, including any adjustable lumbar support positioned thereon/therein, be easy to adjust in shape and also intuitive and/or automatic in its adjustment, as well as use few components.

Most chairs are assembled along a production line. It is desirable to provide a back construction that is adjustable in shape but that uses standard components, that uses components easily interchangeable with other components, and that is assembleable using standard assembly techniques, while at the same time maintaining aesthetics and appearance of the chair.

Accordingly, an apparatus is desired having the aforementioned advantages and solving the aforementioned disadvantages and problems.

SUMMARY OF THE PRESENT INVENTION

In one aspect of the present invention, a back construction for a seating unit includes a back frame having a rigid upright having top and bottom connections, and a flexible back shell configured to support a seated user's upper body, including a pivot pivotally connected to one of the top and bottom connections and a pivot/slide member slidably connected to another of the top and bottom connections. A biasing device is operably coupled to the pivot/slide member that biases the pivot/slide member toward a position where the flexible back shell protrudes forwardly for optimal lumbar support to a seated user.

In another aspect of the present invention, a seating unit includes a rigid upright defining a track, and a flexible back shell configured to support a seated user's upper body, including a top pivot pivotally connected to a top section of the back shell and a pivot/slide member slidably connected to the track of the back shell. A biasing device is operably coupled to the pivot/slide member that biases the pivot/slide member toward a position where the flexible back shell protrudes forwardly to a shape chosen to optimally support a seated user.

These and other aspects, objects, and features of the present invention will be understood and appreciated by those skilled in the art upon studying the following specification, claims and appended drawings.

DETAILED DESCRIPTION OF PREFERRED EMBODIMENTS

The present illustrated back construction 20 (FIG. 1) is usable in the environment of an office chair having a castored spider-legged base, a seat, and an underseat control for pivoting the back 20 and seat with a synchronous motion upon recline of the back 20. A more detailed description of one such chair can be found in U.S. Pat. No. 5,975,634, issued Nov. 2, 1999, entitled CHAIR INCLUDING NOVEL BACK CONSTRUCTION, the entire contents of which are incorporated herein by reference. Nonetheless, it should be understood that the present invention is contemplated to be adaptable for any seating unit or other furniture utilizing a flexible support.

Figure 1:
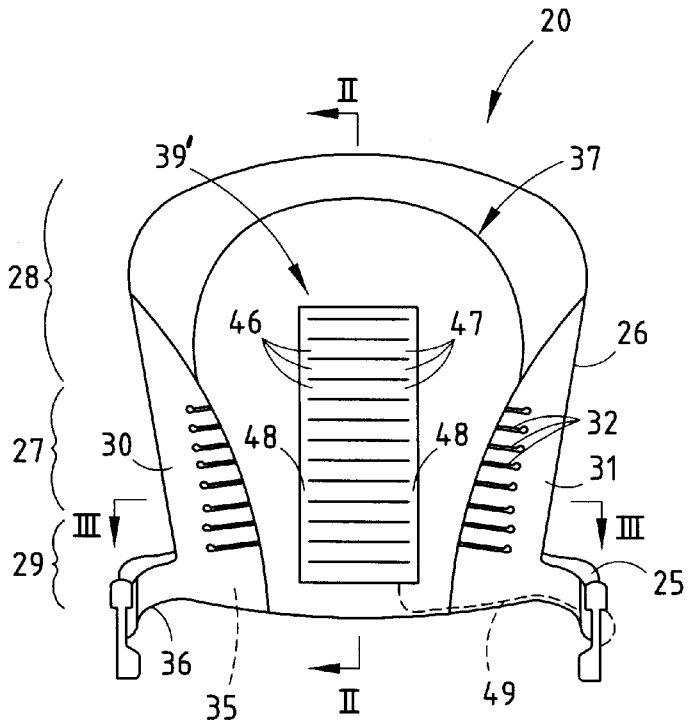
FIGS. 1–3 are front, side, and top views of a back construction including a flexible shell and a removable back covering incorporating an air bladder adjustment mechanism, the adjustment mechanism being inflatable to cause a shape change in a lumbar region of the shell.
Figure 2:
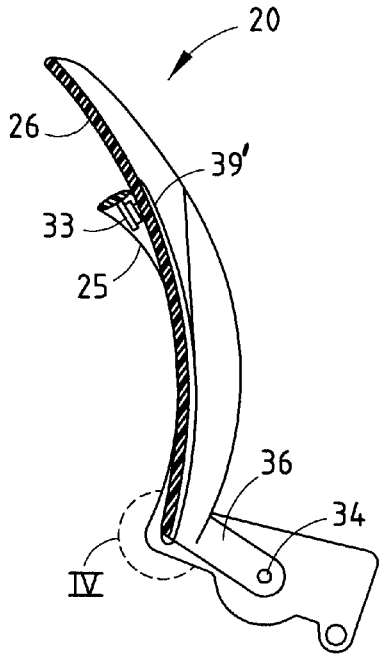
Figure 3:
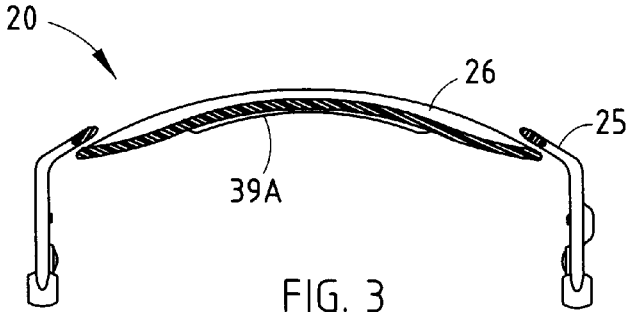

The illustrated back 20 of FIG. 1 includes an arching back frame 25, and a sheet-like flexible plastic back shell 26 pivotally attached to the back frame 25 at top and bottom locations 33 and 34 (FIG. 2). The general operation and interaction of back shell 26 and back frame 25 are described below in sufficient detail for an understanding of the present invention, but details can be found in U.S. Pat. No. 5,975,634, if the reader desires this information.

The back shell 26 (FIG. 1) has a "potato chip" like shape, with its front surface having a horizontal cross section that is forwardly concave, and a vertical cross section that is forwardly convex. The back shell 26 has a flexible lumbar region 27 connecting stiff thoracic and pelvic regions 28 and 29. The lumbar region 27 includes a pair of vertical edge strips 30 and 31, and a plurality of horizontally extending strips 32 separated by slots extending between the edge strips 30 and 31 to define a flexible lumbar area. A belt bracket 35 extends along a lower edge of the back shell 26, and includes forwardly extending flanges 36 that define the bottom pivots 34. In U.S. Pat. No. 5,975,634, a biasing device is provided on the lower pivot to bias the lumbar region forwardly. In the present construction, a muscle-like air bladder energy mechanism is provided in a cover assembly 37, as described below, for changing a shape of the lumbar region 27 of the back shell 26.

The cover assembly 37 (FIG. 5) includes a sock-like top section 38 sewn of upholstery or fabric to define a downwardly-facing pocket 38' that fits mateably over a top edge of the back shell 26 (FIG. 1) and onto the thoracic region 28. A center section 39 of the cover assembly 37 extends downwardly over a center area of the lumbar and pelvic regions 27 and 29. A stiff strip 40 is sewn along a bottom edge of the center section 39, and is shaped to fit mateably into a recess 41' (FIG. 4) in a bottom edge of the back shell 26 with a zipper-like motion, where it is frictionally retained. Fasteners can be used for additional retainment, if desired. It is contemplated that other releasable or permanent top and bottom attachment devices can also be used.

Figure 5:
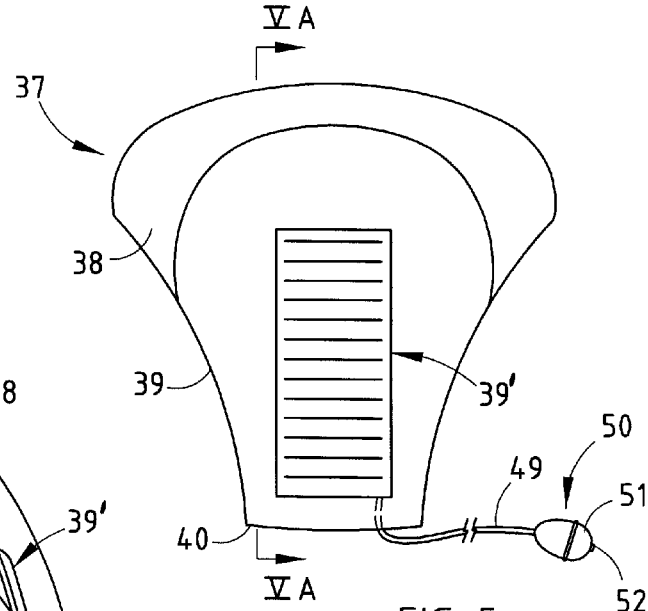
FIG. 5 is a front view of a back cover assembly including the adjustable lumbar support mechanism shown in FIG. 1.

A constrictable energy mechanism 39' in the form of a pleated bladder is attached to the center section 39 (FIG. 5). The energy mechanism 39' extends vertically downwardly onto a front panel of the top section 38. The energy mechanism 39' comprises a laminate (see FIGS. 5C and 5D) with a non-stretchable first inner layer 41 providing strength and flexibility (such as nylon fiber, woven fabric, or the like), and second and third layers 42 and 43 that are air impermeable (or fluid impermeable) (such as rubber or elastomer), and that define a bladder 45 having horizontal cavities 46 (also called "sub-bladders") for receiving air (or other fluid). (It is noted that instead of horizontal cavities, the cavities can be round, oval, or other shapes.) As illustrated, a fourth layer 44 similar to layer 41 is provided. It is contemplated that a variety of different materials can be used to form the bladder, and further, that different inflating fluids can be used other than air.

In the illustrated arrangement, the first and fourth layers 41 and 44 are the outermost and innermost layers, respectively, and are nylon sheets that allow flexibility but that provide good strength in directions within the sheets. For example, 200 denier nylon woven sheeting will work for this purpose. The second and third layers 42 and 43 are elastomeric film, such as ether-based urethane, having an 85 Durometer. The layers 41–44 are bonded together by radio frequency (RF) welding or other bonding technique around their perimeter to define a bladder. The layers 41–44 are further bonded together at multiple horizontal pleats 47 (FIG. 6) that extend partially horizontally across the bladder area to subdivide the bladder into multiple discrete horizontally-extending sub-bladders 46 between the pleats. The sub-bladders 46 are connected at edges by air-communicating edge passages 48. An air line 49 is attached to the bladder 45, and a hand pump 50 is attached to the air line 49. The pump 50 can be located at different locations. As illustrated, the pump 50 (FIG. 6A) is located along a side of the seat 23, but it could also be located under an armrest 51 of the chair, under the seat 23, on the back 20 such as at a bottom or at a top in a headrest area, on a base of the chair, or at other locations. The air pump 50 includes a flexible bulbous member 51 that can be repeatedly manually squeezed to pump air through the line 49 into the bladder 45, and further includes a valve 52 that can be opened to release air from the bladder through line 49 to atmosphere. It is contemplated that a powered air pump, such as a battery-powered pump, could be used instead of a manual pump. Further, a flowable fluid other than air could be used, such as a liquid pumped from a container under the seat.

When deflated or uninflated (see FIGS. 5A and 5C), the illustrated energy mechanism 39 has a thickness of about 5 mm, and the pleats 47 are spaced vertically apart about 15 mm to 20 mm, or more preferably about 19 mm apart. When inflated, each sub-bladder 46 expands from its "linear" shape toward a cylindrical horizontal shape (see FIGS. 5B and 5D), such that a gross vertical length of the cover assembly 37 shortens. If the back shell 26 had a flat horizontal cross section, this shortening of the bladder would cause the back shell 26 to bend toward a more planar condition. However, since the edge strips 30 and 31 of the back shell 26 are forward of the sub-bladders 46, the illustrated back shell 26 actually flexes toward a more curvilinear shape as the sub-bladders 46 are inflated. (Compare FIG. 5A, which has a deep concave shape shown by dimension $T_1$, and FIG. 5B, which has a shallower concave shape shown by dimension $T_2$.) Notably, the total surface length of the outer and inner layers 41 and 44 always stays the same. As a result, when the bladder 45 is inflated, it reacts much like a human muscle and shortens. For example, the spacing between pleats 47 changes from a dimension "X" of about 19 mm (FIG. 5D) to a vertical spacing of about 13 to 15 mm (dimension "Y", FIG. 5C) (depending on the amount of air pumped into the bladder 45).

Figure 5A:
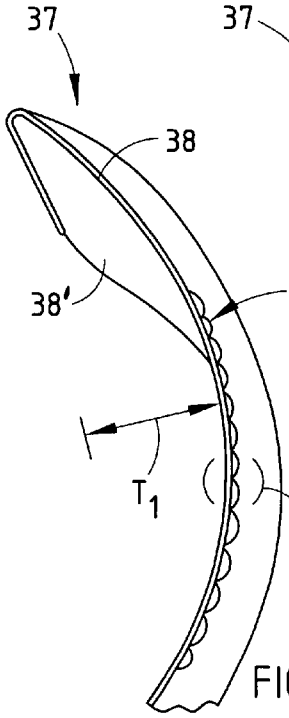
FIG. 5A is a cross section taken along line IV—IV in FIG. 4, the air bladder being inflated and in an energized state.
Figure 5B:
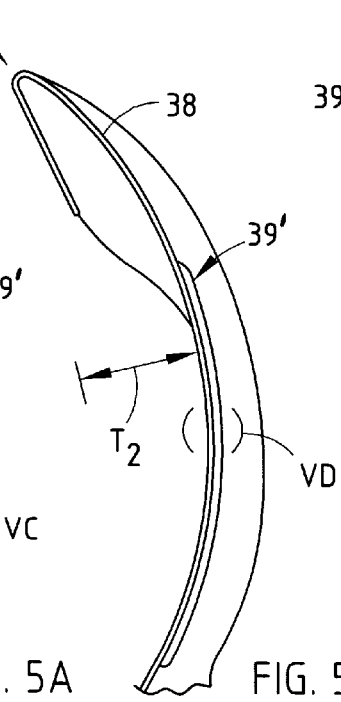
FIG. 5B is a cross section similar to FIG. 4A, but the air bladder being uninflated and in a relaxed state.
Figure 5C:
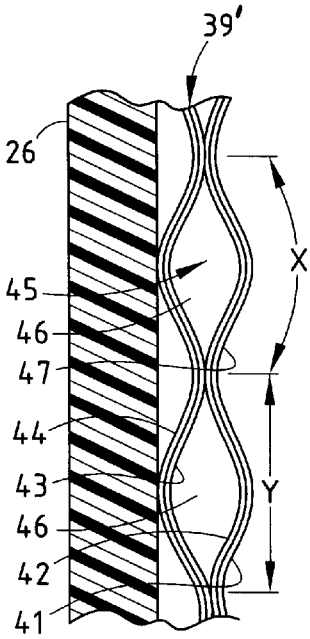
FIGS. 5C and 5D are enlargements of the circled areas VC and VD in FIGS. 5A and 5B.
Figure 5D:
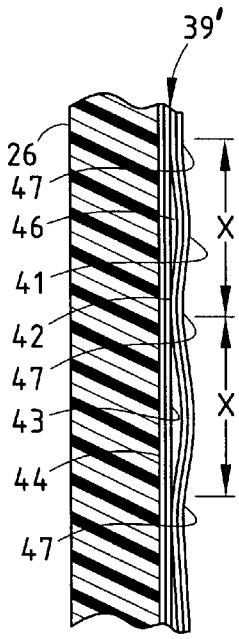

To operate the present invention, the chair 21 is originally provided with the air bladder 45 not inflated. In this condition, the back shell 26 has a predetermined curved shape, as determined by parameters of the chair 21. The cover assembly 37 lies generally flat against the back shell 26 and provides a small amount of comfort on a front of the back shell to a seated user. As air is pumped into the bladder 45, the sub-bladders 46 begin to inflate. This causes the bladder 45 to shorten in a length direction. In turn, the back shell 26 is stressed as the bladder 45 shortens and the edge strips 30 and 31 resist shortening. This causes the back shell 26 to change its shape and flex toward a more curved shape. Also, the air provides some additional cushioned support to a seated user. When air is released from the bladder 45, the process is reversed, and the back shell 26 moves toward a more linear shape (which is closer to its natural unstressed shape). It is noted that the back shell 26 can be made with enough internal strength to flex toward the relaxed convex shape as shown in FIG. 5A. Alternatively, a biasing device (such as is illustrated in U.S. Pat. No. 5,975,634, previously incorporated by reference) can be used to assist in biasing the back shell to its forwardly convex shape. It is noted that the illustrated bladder 45 acts both to bias the back shell 26 to a more concave shape, but also combines with the back shell 26 to act like (and produce lumbar support forces similar to) a stiffer back shell (26) (e.g. a back shell made of stiffer material or made with a thicker dimension).

It is noted that the air in bladder 45 provides both an energizing system, and also a cushioning action for supporting a seated user. This multi-functional use has advantages in terms of comfort to a seated user. If the air is heated, the air bladder has further functional benefits. It is noted that a liquid can be used instead of air, if desired. In such case, the liquid could be stored in a reservoir anywhere on the chair, such as under the seat, in an armrest, in the back, or in the base of the chair.

By controlling the vertical spacing of the pleats 47, the operation of flexing the lumbar region 27 is greatly affected.

For example, closer vertical spacing of the pleats 47 results in a cover assembly 37 that does not shorten as much as it is filled with air. In turn, closer spacing of the pleats 47 results in a lumbar adjustment mechanism that is not able to make as great of a change to the shape of the lumbar region 27. Also, the back shell itself can be given different original concave shapes. Thus, the combined system of the back shell and the cover assembly is important to overall operation. It is contemplated that the bladder 45 could also be positioned horizontally, instead of vertically, such that its operation causes a horizontal shape change. Still further, a horizontal bladder and a vertical bladder (and/or an angled bladder) can be overlaid or used together to control the back shape in all directions, or the sub-bladder shapes can be dome-shaped, elongated but nonlinear (e.g. L-shaped or Z-shaped), elongated in multiple directions (e.g. X-shaped or Y-shaped), or any other shape desired.

Figure 6:
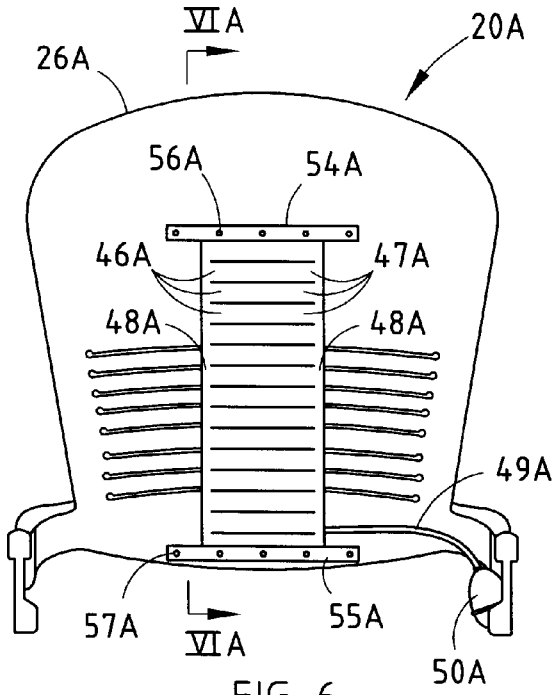
FIGS. 6 and 6A are front and side views of a modified back construction including a permanently-attached inflated/energized lumbar adjustment mechanism.
Figure 6A:
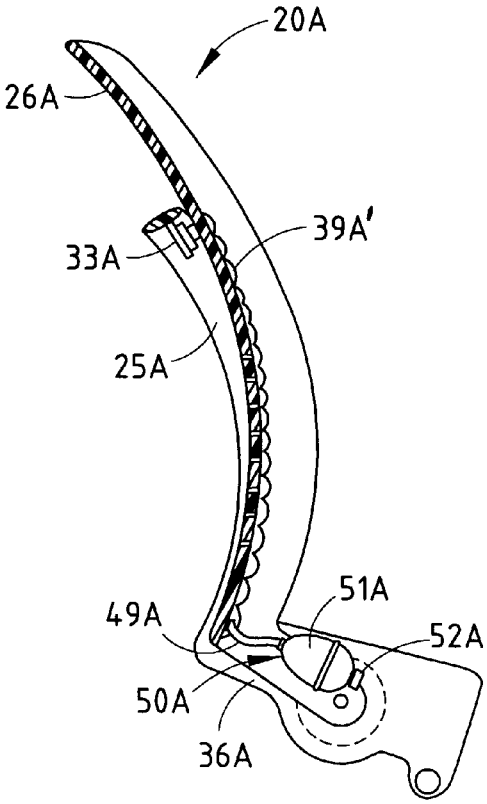
Figure 6B:
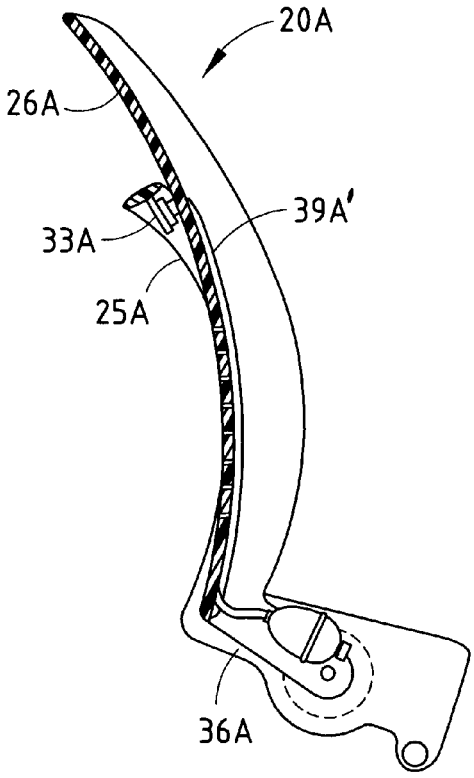
FIG. 6B is a side view similar to FIG. 6A, but with the bladder deflated.
Figure 7:
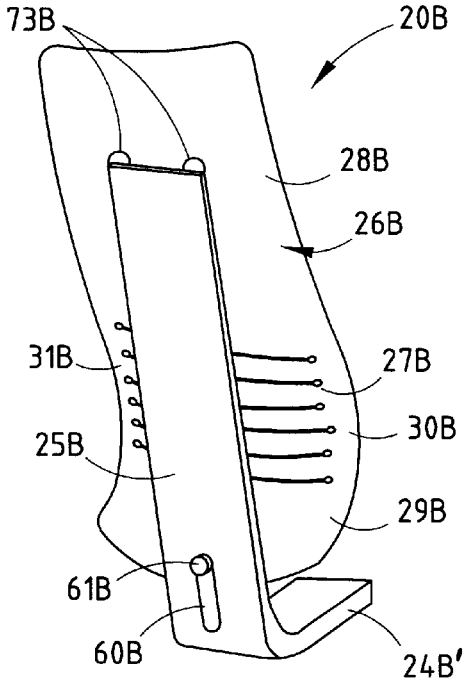
FIGS. 7–8 are perspective and side views of another modified back construction including a permanently-attached inflated/energized lumbar adjustment mechanism.
Figure 8:
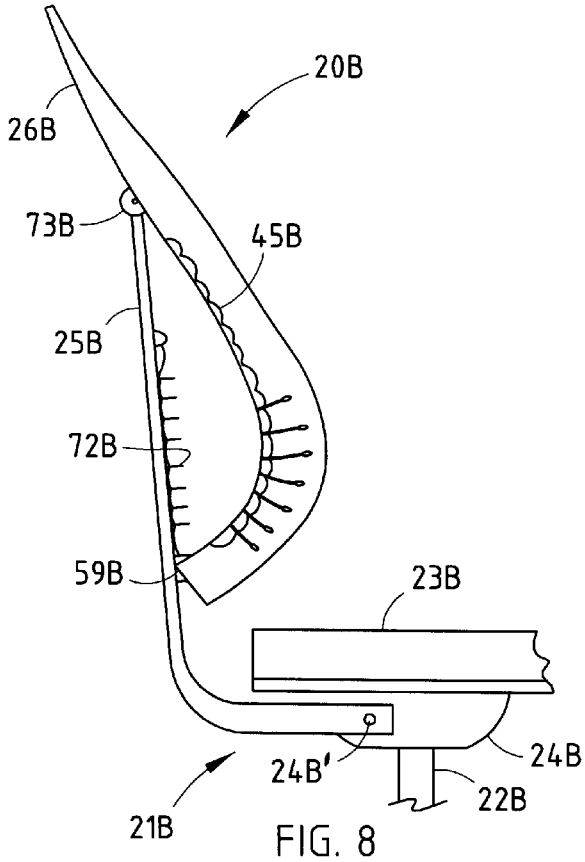
Figure 9:
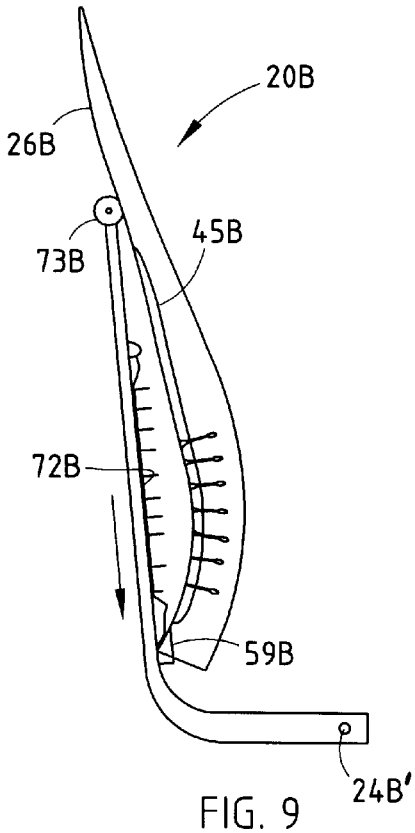
FIG. 9 is a side view similar to FIG. 8, but with the bladder deflated.
Figure 10:
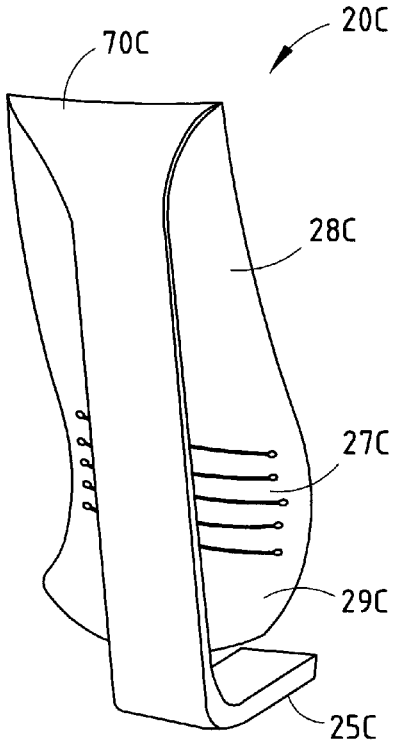
FIGS. 10–12 are views of another modified back construction, the views of FIGS. 10–12 being similar to FIGS. 7–9 above.
Figure 11:
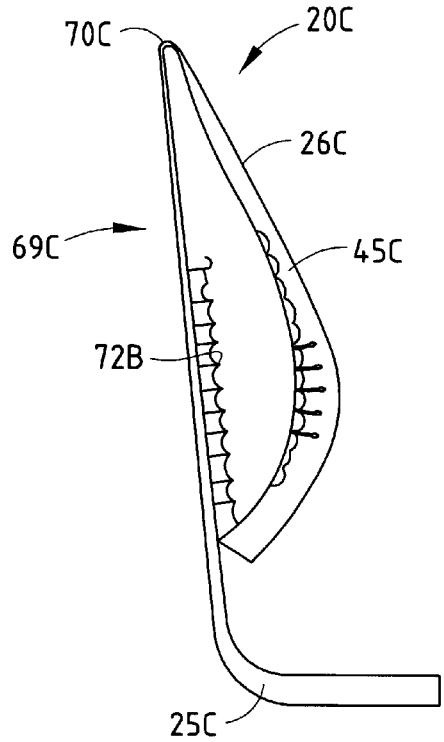
Figure 12:
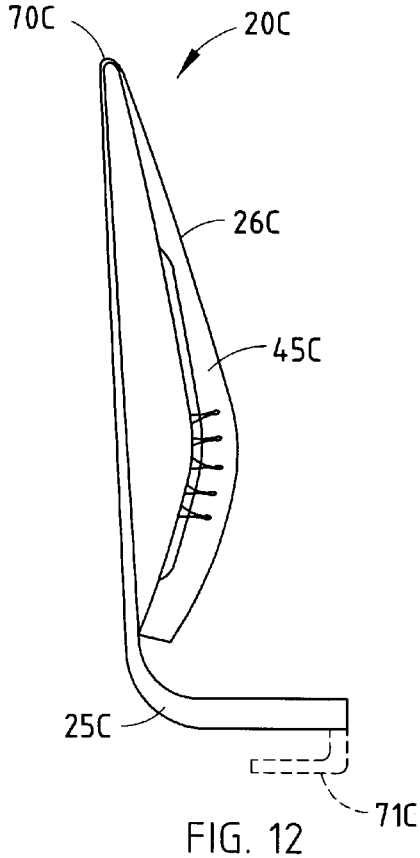

A modified back construction 20A is shown in FIGS. 6–6B, a second modified back construction 20B is shown in FIGS. 7–9 on chair 21B, and a third modified back construction 20C is shown in FIGS. 10–12. In these embodiments, all similar or identical features and components are identified using the same number as used in back construction 20, but with the addition of a letter "A", "B", or "C". This is intended to reduce redundant discussion, and not for another purpose. A person of ordinary skill in the art will understand that principles discussed in regard to each embodiment will apply to the other embodiments.

The modified back construction 20A (FIG. 6) includes a back shell 26A, a bladder 45A permanently attached to the back shell 26A, and upholstery (not specifically shown) attached over the bladder 45A and back shell 26A to aesthetically cover the same. More specifically, the bladder 45A includes top and bottom stiff edge sections 54A and 55A attached with rivets 56A and 57A. The bladder 45A includes pleats 47A subdividing it into sub-bladders 46A. The remaining components and operation are identical to or very similar to the back construction 20, and thus the details will not be repeated to avoid unnecessary repetition.

Another modified back construction 20B (FIG. 8) is shown as part of a chair 21B having a castored spider-legged base 22B, a seat 23B, the back construction 20B, and an underseat control 24B for pivoting the back 20B and seat 23B with a synchronous motion upon recline of the back 20B. In chair 21B, the back construction 20B includes a back frame 25B pivoted to the base 22B under the seat 23B at pivot location 24B' for reclining movement. A biasing device, such as a torsion spring, is attached at the pivot location 24B'. A flexible back shell 26B is pivotally attached to a top of the back frame 25B, but is slidably supported at its lower edge by a slide member 59B on a lower portion of the back frame 25B. When inflated, the bladder 45B causes the back shell 26B to flex from its semi-linear shape (FIG. 9) toward a more curved shape (FIG. 8), causing the slide member 59B to slide upwardly along the back frame 25B. The back frame (or upright) 25B includes a vertical slot 60B and a follower 61B attached to a bottom edge of the back shell 26B is slidably coupled to the slot 60B. Top and bottom ends of the slot 60B limit flexing of the back shell 26B by engaging the follower 61B as the back shell 26B is flexed. A spring 72B is attached between the follower 61B and the top pivot connection 73B on a top of the back frame 25B. The spring 72B compliments leaf-spring-like edge strips 30B and 31B to cause the back shell 26B to naturally move toward a curved shape.

Figure 9A:
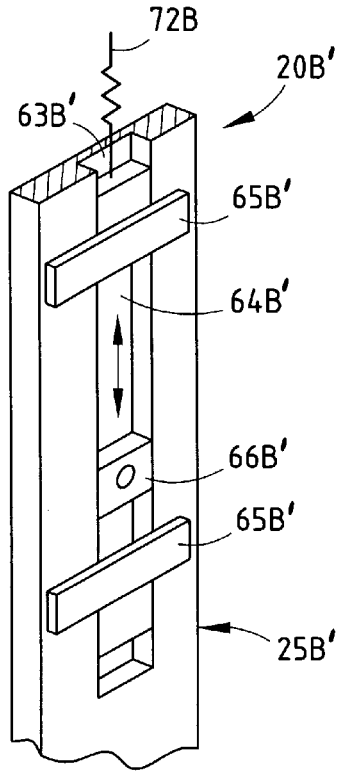
FIG. 9A is a fragmentary perspective view of an inside of the rear upright showing details of the slide mechanism in FIGS. 7–9.

Back construction 20B' (FIG. 9A) replaces the slot 60B and follower 61B with a channel/track 63B' formed on an inside of the upright back frame 25B', and an elongated follower 64B' that rides in the channel/track 63B'. Straps 65B' hold the follower 64B' in the channel/track 63B', and also act as upper and lower limits as the shell-attachment brackets 66B' engages them.

Back construction 20C (FIG. 11) is similar to the back construction 20B (FIG. 8), except back construction 20C has a one-piece member 69C with a rigid L-shaped back frame 25C coupled to the back shell 26C by a living hinge 70C. Also, a hook 71C can be provided on the lower leg of the L-shaped back frame 25C. Optionally, hook 71C is designed to hookingly engage a flat member, such as a bench or bleacher seat in a football stadium.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A back construction for a seating unit comprising:

a back frame including a rigid upright having top and bottom connections;

a flexible back shell configured to support a seated user's upper body, including a pivot pivotally connected to one of the top and bottom connections and a pivot/slide member slidably connected to another of the top and bottom connections; and a spring operably coupled to the pivot/slide member that biases the pivot/slide member toward a position where the flexible back shell protrudes forwardly for optimal lumbar support to a seated user.

2. The back construction defined in claim 1, wherein the pivot/slide member is slidably connected to the bottom connection.

3. The back construction defined in claim 2, wherein the bottom connection includes vertically-elongated surfaces defining a track.

4. The back construction defined in claim 3, wherein the pivot/slide member includes a follower slidably engaging the track.

5. The back construction defined in claim 4, wherein the vertically-elongated surfaces are formed on a hidden side of the upright and define a channel that faces forwardly toward the back shell.

6. The back construction defined in claim 1, including a one-piece member including portions forming the upright and the back shell, and including a living hinge connecting the upright and back shell.

7. The back construction defined in claim 1, wherein the back frame includes a hooking portion constructed to releasable engage a front edge of a bench seat with the back construction resting on the bench seat, so that the back construction can be carried to a location and hooked on the bench seat to provide comfortable support while watching a sporting event.

8. A seating unit comprising, in combination:

a base;

a seat supported on the base; and the back construction defined in claim 1, the back frame being attached to one of the base and the seat.

9. The seating unit defined in claim 8, wherein the base includes an under-seat control, and the back frame is pivotally supported by the under-seat control for movement between upright and reclined positions.

10. A back construction for a seating unit comprising:

a back frame including a rigid upright having top and bottom connections, the bottom connection including vertically-elongated surfaces defining a track;

a flexible back shell configured to support a seated user's upper body, including a pivot pivotally connected to the top connection, and a pivot/slide member slidably connected to the bottom connection, the pivot/slide member including a follower slidably engaging the track; and that biases the pivot/slide member toward a position where the flexible back shell protrudes forwardly for optimal lumbar support to a seated user.

11. A seating unit comprising:

a rigid upright defining a track;

a flexible back shell configured to support a seated user's upper body, including a top pivot pivotally connected to a top of the rigid upright and a pivot/slide member slidably connected to the track of the rigid upright; and a spring operably coupled to the pivot/slide member that biases the pivot/slide member toward a position where the flexible back shell protrudes forwardly to a shape chosen to optimally support a seated user.

12. The seating unit defined in claim 11, including vertically-elongated surfaces formed on a hidden side of the upright that face forwardly toward the back shell.

13. The seating unit defined in claim 11, including a one-piece member including portions forming the upright and the back shell, and including a living hinge connecting the upright and back shell.

14. The seating unit defined in claim 11, wherein the back frame includes a hooking portion constructed to releasably engage a front edge of a bench seat with the back construction resting on the bench seat, so that the back construction can be carried to a location and hooked on the bench seat to provide comfortable support while watching a sporting event.

15. The seating unit defined in claim 11, including a base having an under-seat control, wherein the back frame is pivotally supported by the under-seat control for movement between upright and reclined positions.

16. A seating unit comprising:

a rigid upright defining a track;

a flexible back shell configured to support a seated user's upper body, including a top pivot pivotally to a top of the rigid upright and a pivot/slide member slidably connected to the track of the rigid upright; and a linearly extendable spring attached at one end to the pivot/slide member and at another end to the upright that biases the pivot/slide member toward a position where the flexible back shell protrudes forwardly to a shape chosen to optimally support a seated user.

17. A back construction for a seating unit comprising:

a back frame including a rigid upright having top and bottom connections;

a flexible back shell configured to support a seated user's upper body, including a pivot pivotally connected to one of the top and bottom connections and a pivot/slide member slidably connected to another of the top and bottom connections; and a biasing device operably coupled to the pivot/slide member that biases the pivot/slide member toward a position where the flexible back shell protrudes forwardly for optimal lumbar support to a seated user, the biasing device being configured to provide a continuous bias and the pivot/slide member being continuously slidable and not held in a fixed position, so that the back sheet flexes and extends as the seated user's upper body flexes.

* * * * *

UNITED STATES PATENT AND TRADEMARK OFFICE

CERTIFICATE OF CORRECTION

Figure 4:
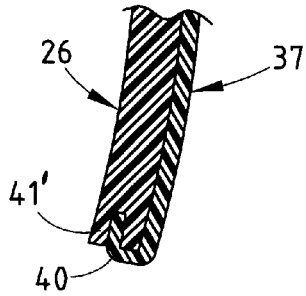
FIG. 4 is an enlarged side view of a bottom portion of the back shell and bladder in the circled area IV in FIG. 2, the back frame being removed for clarity.

PATENT NO. : 6,616,228 B2
DATED : September 9, 2003
INVENTOR(S) : Kurt R. Heidmann It is certified that error appears in the above-identified patent and that said Letters Patent is hereby corrected as shown below:

Column 2,
Line 13, "line IV-IV in Fig. 4" should be -- line VA-VA in Fig. 5 --;

Column 5,
Line 60, after "263", insert -- and that --;

Column 6,
Lines 53-54, "releasable" should be -- releasably --;

Column 8,
Line 9, after "pivotally", insert -- connected --;

Column 7,
Line 10, after "track; and", insert -- a linearly extendable spring attached at one end to the pivot/slide member and at another end to the upright --.

Signed and Sealed this

Twenty-second Day of March, 2005

JON W. DUDAS
*Director of the United States Patent and Trademark Office*